United States Patent [19]

Schaumann

[11] 3,936,897

[45] Feb. 10, 1976

[54] BUOYANT WATER-WALKING APPARATUS

[76] Inventor: Peter H. Schaumann, 15 Jasmine Lane, Spanish Lakes, Fort Pierce, Fla. 33450

[22] Filed: Sept. 21, 1973

[21] Appl. No.: 400,193

[52] U.S. Cl. ..... 9/310 D

[51] Int. Cl.[2] ..... A63C 15/00

[58] Field of Search ..... 9/310 R, 310 B, 310 D, 9/310 C, 310 E; 115/21

[56] References Cited

UNITED STATES PATENTS

| | | | |
|---|---|---|---|
| 1,057,731 | 4/1913 | Halbow | 9/310 D |
| 2,153,939 | 4/1939 | Schaupp | 9/310 D |
| 3,034,157 | 5/1962 | Abajian | 9/310 D |
| 3,112,504 | 12/1963 | Carlton | 9/310 D |
| 3,121,892 | 2/1964 | Plumlee | 9/310 D |

*Primary Examiner*—Trygve M. Blix
*Assistant Examiner*—Sherman D. Basinger
*Attorney, Agent, or Firm*—Watson, Cole, Grindle & Watson

[57] ABSTRACT

Buoyant water-walking apparatus including a pair of elongated, buoyant, water-walker assemblies adapted for attachment to the feet of a user for the purpose of supporting the weight of the user and enabling him to propel himself over the water. Each of the assemblies comprises a rigid, elongated base member and at least one buoyant flotation member carried by the base member. Additional buoyant flotation members may be added depending on the weight of the user. The flotation members are detachably secured to the base member.

19 Claims, 14 Drawing Figures

4
4

FIG. 7
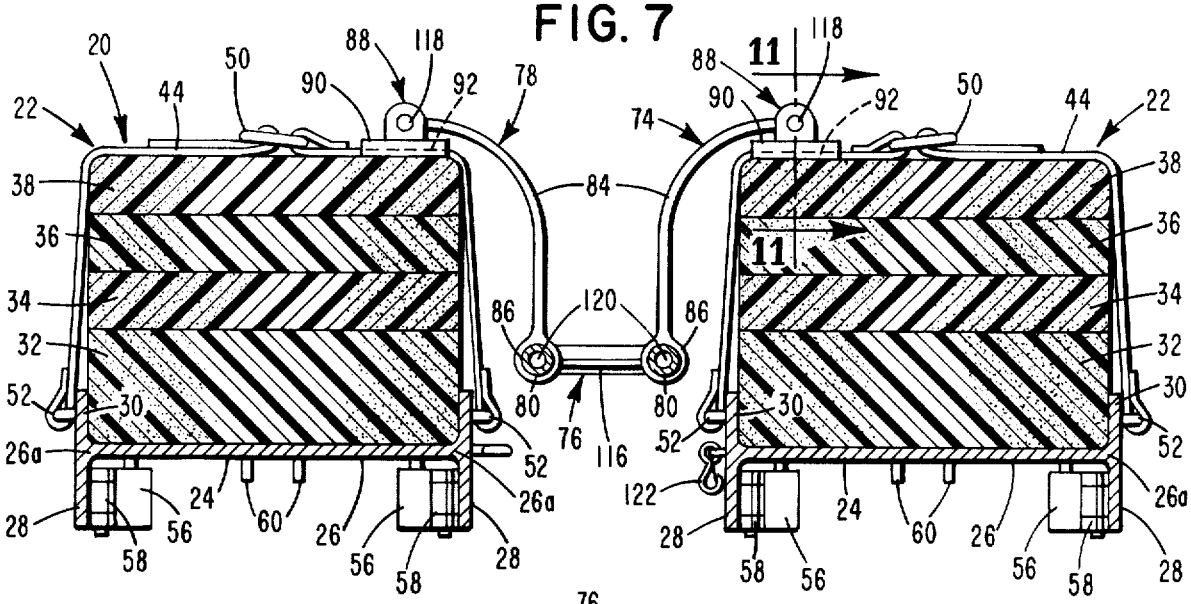
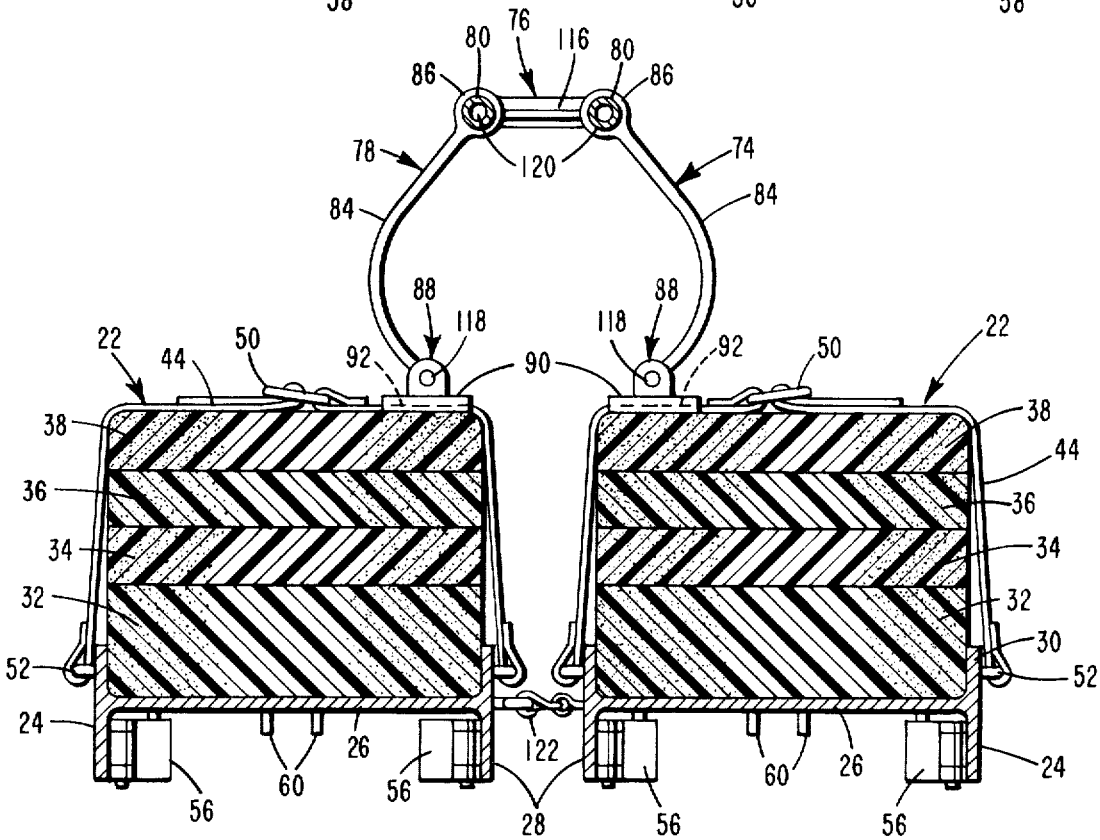
FIG. 8

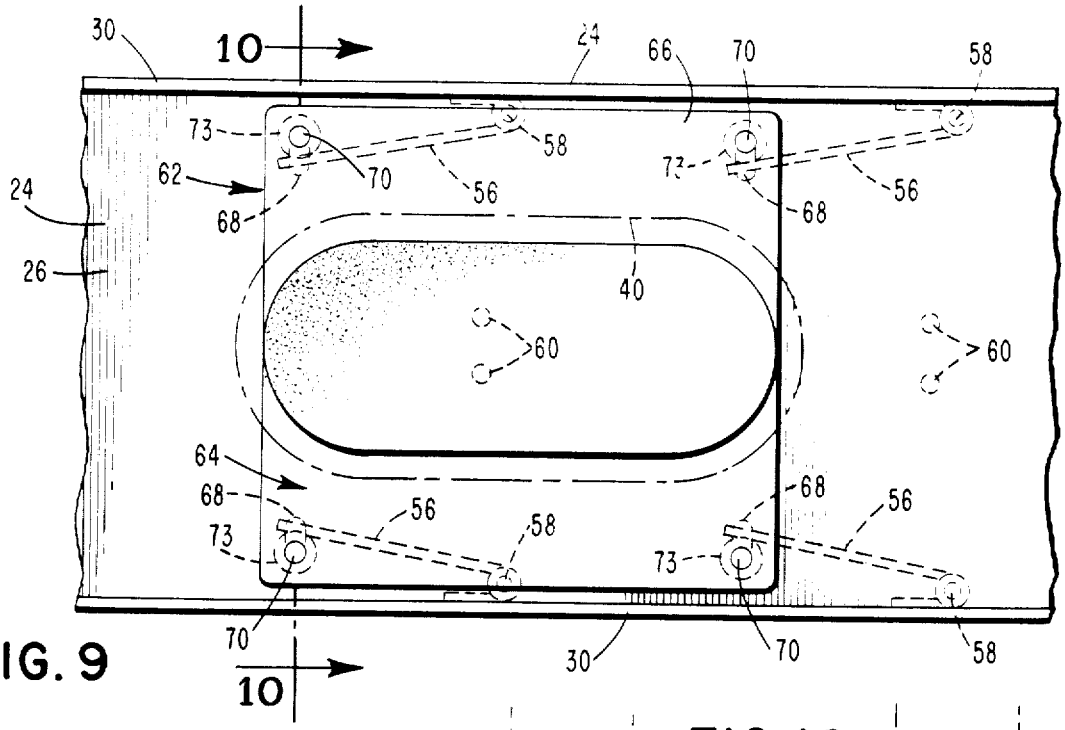
FIG. 9
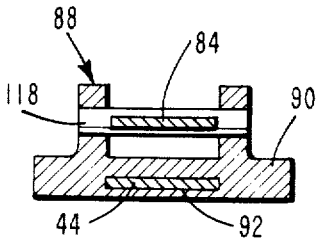
FIG. 11
FIG. 10
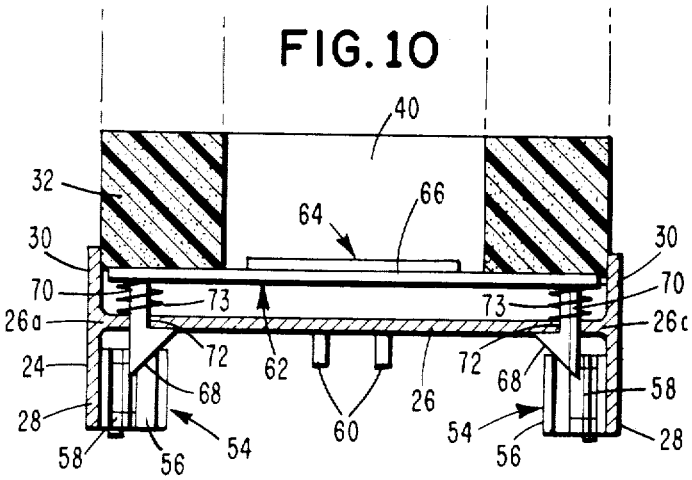
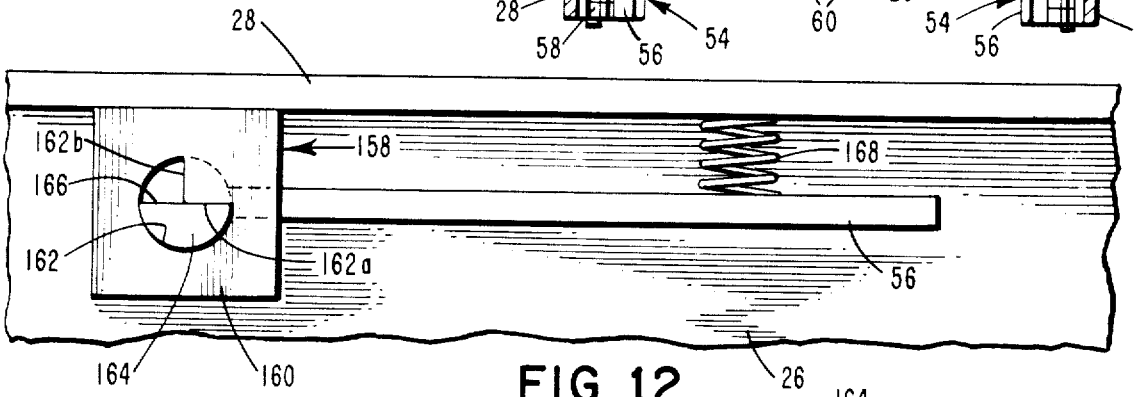
FIG. 12
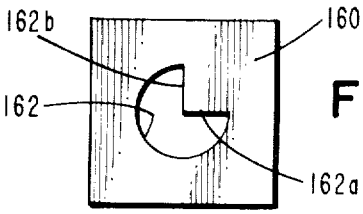
FIG. 13
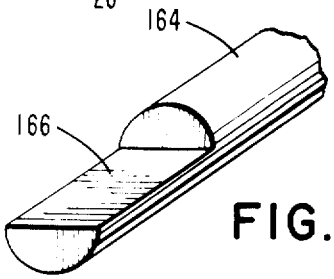
FIG. 14

BUOYANT WATER-WALKING APPARATUS

BACKGROUND OF THE INVENTION

1. Field Of The Invention

The present invention relates to buoyant water-walking apparatus and more particularly to such apparatus which includes a pair of elongated, buoyant water-walker assemblies adapted for attachment to the respective feet of a user for the purpose of supporting the weight of the user in water and enabling him to propel himself over the water while in a standing position.

2. Description Of The Prior Art

Many previous efforts have been made to provide a suitable buoyant water-walking apparatus for the purpose of supporting the weight of a user and enabling him to propel himself across the surface of the water. Such apparatuses have generally taken the form of a pair of elongated, buoyant, water-walker members adapted for attachment to the respective feet of the user. Disclosures of such water-walking apparatuses are found, for example, in the patents to Sheldon, U.S. Pat. No. 1,384,354; Meredith, U.S. Pat. No. 1,533,023; Stephens, U.S. Pat. No. 2,482,074; Fournier, U.S. Pat. No. 2,940,090; Wheat, U.S. Pat. No. 3,084,356; Carlton, U.S. Pat. No. 3,112,504; Plumley, U.S. Pat. No. 3,121,892; Livaudais, U.S. Pat. No. 3,242,898; Davis et al., U.S. Pat. No. 3,566,427; Fairchild, U.S. Pat. No. 3,601,828; La Rocca, U.S. Pat. No. 3,606,624; Mabuchi, U.S. Pat. No. 3,609,782; and Senghas, U.S. Pat. No. 3,621,500.

The foregoing prior art devices all suffer from the common defect of being commercially unsatisfactory because of their constructional design features. Further, these prior art devices do not possess flexibility with respect to accomodating users of various weights. A further shortcoming of the prior art devices disclosed in the foregoing patents is that efficient keels which facilitate straight tracking with a minimum of side-slip have not been provided. Moreover, the prior art retard devices have not performed in a completely satisfactory fashion.

SUMMARY OF THE INVENTION

It is a primary object of the present invention to provide a buoyant water-walking apparatus which includes a pair of elongated, buoyant, water-walking assemblies adapted for attachment to the respective feet of a user wherein each assembly includes a rigid, elongated base member, buoyant flotation members carried by the base member and means for detachably securing the flotation members and the base member together so that the buoyancy of an individual assembly can be adjusted as is necessary to facilitate the weight of the user.

Another very important object of the invention is to provide such an apparatus wherein the base member of each assembly is provided with a pair of laterally spaced, longitudinally extending keels for the purpose of facilitating the straight tracking of each assembly with a minimum of side-slip.

Another very important object of the invention is to provide a retard mechanism for each of the assemblies of such an apparatus wherein the retard mechanism includes a gate element which is swingable about a generally vertical axis. In this same connection it is an aim of the invention to provide retard starter means for swinging the gate elements in the appropriate direction at the beginning of the movement retarding operation.

A further very important object of the invention is to provide guide means for such an apparatus for maintaining the assemblies in parallel relationship during operation while permitting movement of the assemblies longitudinally of one another. In connection with this object of the invention, it is also an aim of the invention to provide means for limiting the longitudinal movement of the assemblies relative to one another to facilitate the length of the stride of the individual user of the apparatus.

The foregoing objects, aims and purposes of the invention are accomplished and the shortcomings of the prior art described above are overcome through the use of a buoyant water-walking apparatus which includes a pair of elongated, buoyant water-walker assemblies adapted for attachment to the feet of a user. Each of the assemblies includes a rigid, elongated base member comprising a longitudinally extending central web section having lateral edges and a pair of longitudinally extending flange sections attached respectively to the corresponding edges of the web section to extend generally normally away from the latter in the same direction to present laterally spaced keels. Each of the assemblies also includes at least one buoyant flotation member carried by said web section, on the opposite side thereof from the direction of extension of the flange sections. The flotation member (or members as the case may be) are generally coextensive in length and width with the web section of the base member and each has an opening extending therethrough in a direction which is generally normal to the major plane of the web section. The opening in the flotation members is adapted for receiving the foot of a user therein. Each assembly also includes means detachably securing the flotation members and the base members together to present said assembly.

In a more specific aspect, each assembly of the apparatus includes a retard mechanism mounted between the keels thereof for impeding the movement of the assembly through the water in one longitudinal direction and permitting substantially unimpeded movement thereof in the opposite, longitudinal direction. The retard mechanism comprises a gate element and means mounting the element on the base member for swinging about an axis extending perpendicularly relative to the major plane of the web section. Even more specifically, the retard mechanism may comprise a pair of such gate elements, each element having a length which is approximately one-half the width of the central web of the base member and each being swingable about an axis disposed adjacent a respective keel. The axes of swinging of the elements being disposed on opposite sides of the base member. In connection with this aspect of the invention and in its more preferred form, each assembly may include two retard mechanisms disposed in longitudinally spaced relationship. It is preferred that each gate element of each retard mechanism be swingable between a first position where the gate element is disposed to extend longitudinally of the keels of the assembly to permit said substantially unimpeded movement and a second position where each gate element is disposed to extend laterally of the keels to impede the movement of the assembly. In this connection, each mechanism preferably includes stop means disposed for limiting the swinging movement of the gate elements to maintain the latter in their second positions during the impeded movement of the assembly.

In a further specific aspect of the invention, each retard mechanism preferably includes retard starter means comprising a foot actuated, spring loaded operator means and wedge means coupled to said operator means for movement by the latter to force each gate element toward its second position at the beginning of the impeded movement. Specifically, the operator means preferably comprises a plate mounted in the foot opening of the assembly for movement toward and away from the central web of the base member. Spring means are provided for biasing the plate away from the web. The wedge means preferably comprises a wedge for each gate element disposed for movement toward and away from the web on the opposite side of the latter from the plate and between the corresponding gate element and the keel adjacent thereto. Means are included for rigidly coupling the wedges and the plate whereby movement of the latter toward the web causes a corresponding movement of the wedges to force the gate elements away from the keels and toward their second positions.

In another more specific aspect of the invention, guide means are provided for maintaining the assemblies in parallel relationship during operation, the guide means preferably comprising an elongated, tubular frame, extending longitudinally of the assemblies and therebetween. Arm means carried by each assembly are provided for interconnecting the latter and the frame. Each arm means includes an arm element and a fitting mounting the corresponding arm element on the frame for longitudinal movement therealong and swinging movement relative thereto about an axis extending generally longitudinally of the assemblies. The frame preferably comprises a pair of tubular lengths extending longitudinally of the assemblies in laterally spaced relationship and a bight portion at each end of the frame interconnecting said lengths. The fittings on the arms preferably comprise rings disposed in encircling relationship to a corresponding one of the lengths. The arm means of each assembly preferably comprises a pair of longitudinally spaced arm elements, each arm element comprising an elongated arm having the ring at one end thereof. Also included are means mounting the other end of each arm on the corresponding assembly for swinging movement about an axis extending longitudinally of the assembly. The arms of each assembly are preferably curved and the means mounting each arm on the respective assembly is disposed on top of the upper most flotation member thereof whereby the frame may be swung upwardly relative to each assembly from a position between the latter to a position above the assemblies. In its preferred form, the apparatus includes stop means releasably clamped to the lengths of the frame. These stop means are slidable along said lengths when released for movement to a position for limiting the longitudinal movement of each assembly relative to the frame.

In another more specific preferred embodiment of the invention, a longitudinal extension is included at one end of the base member of each assembly and a hollow, buoyant container is mounted on such extension.

BRIEF DESCRIPTION OF THE DRAWINGS

FIG. 7 is a elevational, cross-sectional view of the apparatus taken along the line 7—7 of FIG. 5;

FIG. 8 is a cross-sectional, elevational view similar to FIG. 7 but with the frame swung upwardly to a position above the assemblies;

FIG. 9 is a partial top plan view of the base member of an assembly disclosing an embodiment of the invention which includes retard starter means for the retard mechanism;

FIG. 10 is an elevational, cross-sectional view taken substantially along the line 10—10 of FIG. 9;

FIG. 11 is an enlarged, elevational cross-sectional view taken substantially along the line 11—11 of FIG. 7;

FIG. 12 is an enlarged detail view illustrating another embodiment of the retard starter means and of stop means for the retard gate element;

FIG. 13 is an enlarged detail view of the bushing of the stop means of FIG. 12; and FIG. 14 is an enlarged perspective view of the pivot shaft for the gate element used in connection with the bushing of FIG. 13.

DESCRIPTION OF THE PREFERRED EMBODIMENTS

Figure 4:
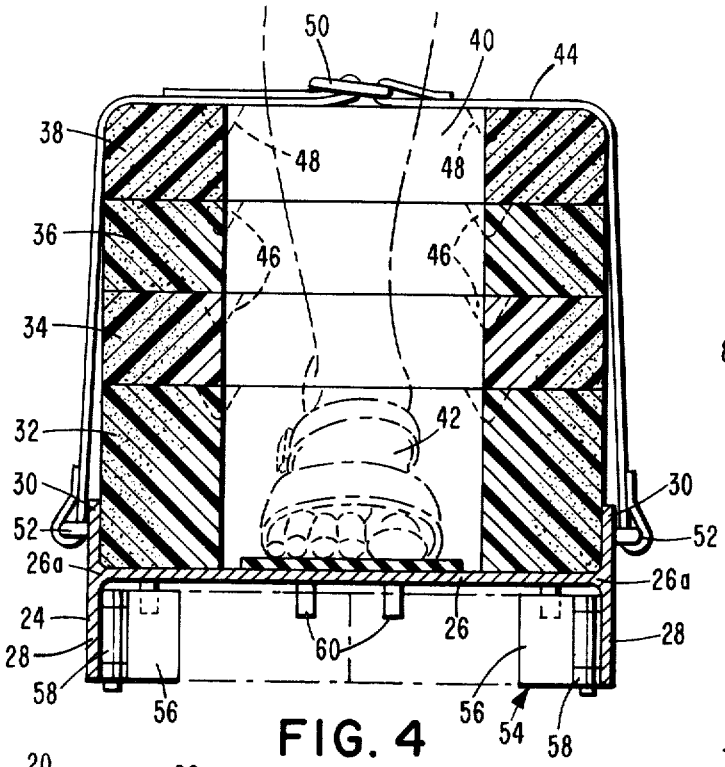
FIG. 4 is an elevational, cross-sectional view taken along the line 4—4 of FIG. 2.
Figure 5:
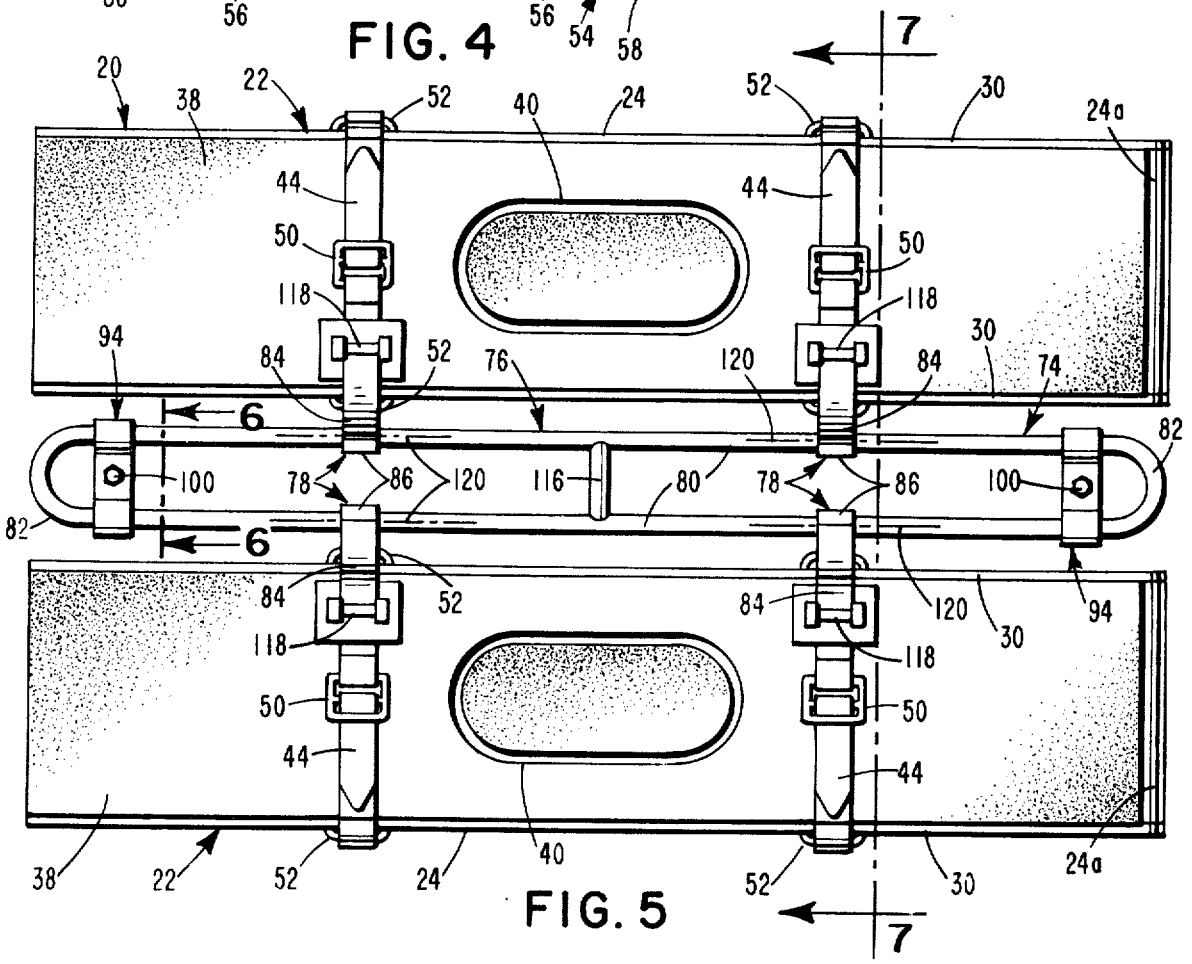
FIG. 5 is a partial, top plan view of a buoyant water-walking apparatus which includes a pair of the elongated, buoyant water-walker assemblies, said assemblies being interconnected by a guide means for maintaining the assemblies in parallel relationship during operation.

A buoyant, water-walking apparatus embodying the principles and concepts of the present invention is illustrated in FIG. 5 of the drawings and is broadly designated by the reference numeral 20. Apparatus 20 includes a pair of elongated, buoyant water-walker assemblies 22 adapted for attachment to the feet of a user of the apparatus. The assemblies 22 are identical in all substantial respects and the details of the same are illustrated in FIGS. 1, 2, 3 and 4.

Each assembly 22 includes a rigid, elongated base member 24 preferably constructed of a light weight metal such as aluminum or the like. Member 24 has a longitudinally extending central web section 26 having lateral edges **26*a* at each side thereof. A longitudinally extending flange section 28 is attached to each edge 26*a* of section 26. Flange sections 28 extend generally normally away from section 26 in the same direction as can be seen particularly in FIG. 4. It is to be appreciated that flanges 28 present laterally spaced keels which are operable to facilitate the straight tracking of assembly 22** with a minimum of side-slip.

Viewing FIG. 4 it can be seen that the base member 24 preferably has a generally H-shaped transverse cross-sectional configuration presenting central web section 26, flanges or keels 28 and a pair of laterally spaced, longitudinally extending wall sections 30 which extend away from web section 26 in the opposite direction from the direction of extension of keels 28. The forward most end **24*a* of base member 24 is preferably curved upwardly to facilitate the movement of the assembly 22** through the water in the direction of end 24*a*.

Each assembly 22 also includes at least one buoyant flotation member 32 carried by web section 26. Preferably, member 32 may be constructed from a single block of plastic foam material, such as, for example, styrafoam. In this connection, it should be appreciated, however, that many relatively light weight, buoyant materials known to those skilled in the art could be utilized as the material of construction for flotation member 32. For example, polyurethane foam could be utilized in place of the styrafoam. Other materials of construction for member 32 include cork or balsa wood and the same could have a construction of metal or plastic to present a hollow flotation space. That is to say, the exact means for rendering members 32 buoyant is not a critical feature of the present invention.

Figures 1, 2, 3:
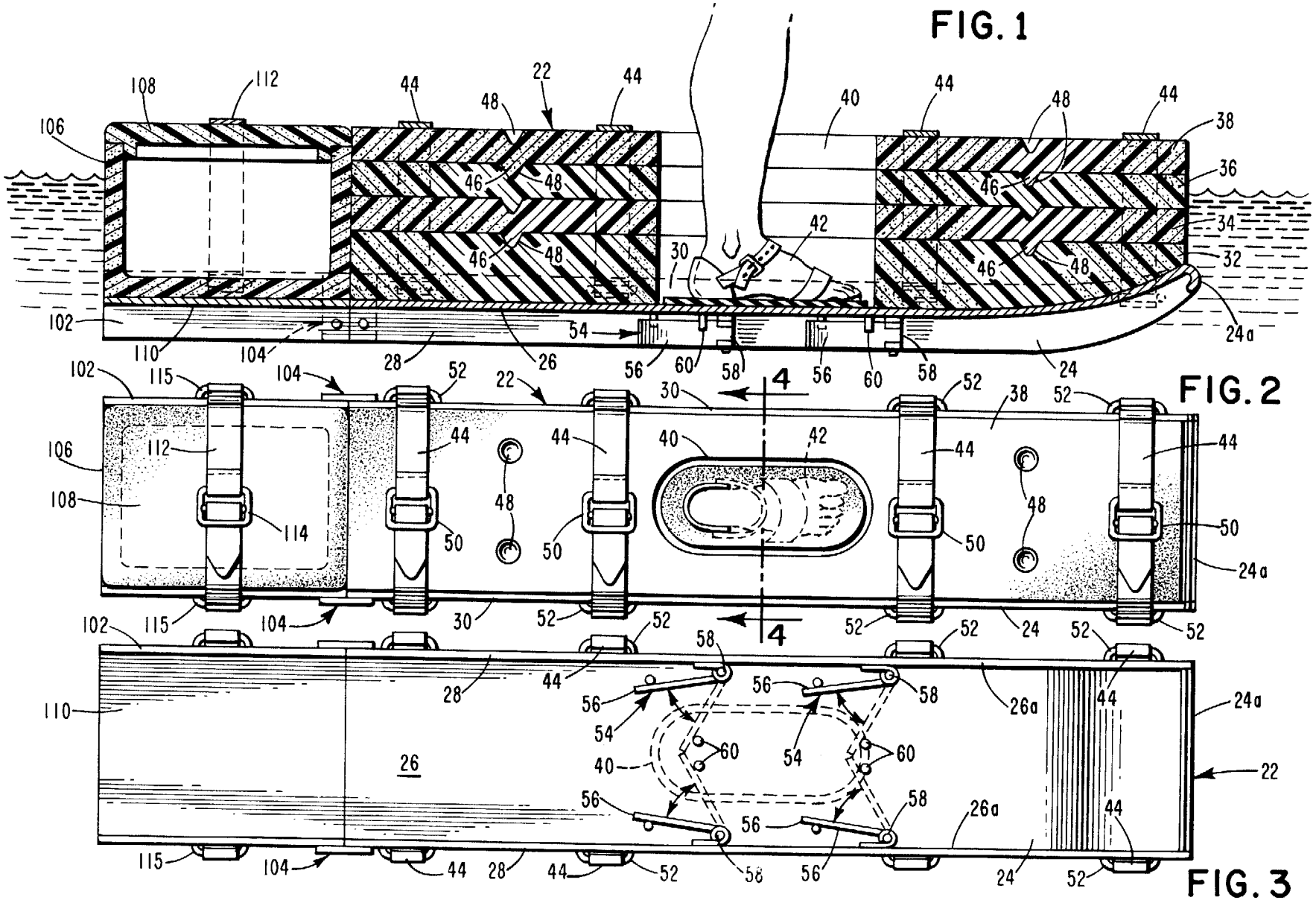
FIG. 1 is a cross-sectional elevational view of an elongated, buoyant, water-walker assembly contructed in accordance with the concepts and principles of the present invention.
FIG. 2 is a top plan view of the assembly.
FIG. 3 is a bottom plan view of the assembly.

As can be seen in FIG. 1, additional buoyant flotation members 34, 36 and 38 may be included, as desired to provide assembly 22 with a sufficient amount of buoyancy to support a given user of the apparatus. That is to say, for lighter weight users, fewer additional buoyant members would be utilized and with heavier users, buoyant flotation members even in addition to the members 32, 34, 36 and 38 might be utilized. Manifestly, members 34, 36 and 38 as well as in other such members utilized would be constructed of the materials disclosed as useful in connection with member 32.

As can be seen particularly in FIGS. 1 and 4, the member 32, 34, 36 and 38 are coextensive in length and width with base member 24. Further, each buoyant flotation member is provided with an opening 40. The openings 40 of flotation members 32, 34, 36 and 38 are vertically aligned and extend normally with respect to the major plane of web section 26 providing access for the foot 42 of a user of the apparatus. As can be seen in FIG. 1, conventional means for attaching the assembly to the foot 42 are provided at the bottom of the well presented by the openings 40. Also, it is to be noted viewing FIG. 1 that the members 32, 34, 36 and 38 may be maintained in a predetermined relative relationship by a series of aligned protrusions 46 and holes 48.

Means in the nature of straps 44 are provided for detachably securing flotation members 32, 34, 36 and 38 to base member 24 whereby to present assembly 22. Each strap 44 is provided with a conventional buckle 50 by means of which the straps may be tightened and maintained in a tightened condition. Brackets 52 carried by base member 24 are provided for facilitating the attachment of straps 44 to the assembly.

Each of the assemblies is provided with a retard mechanism 54 mounted between keels 28 for impeding the movement of the assembly through the water in a direction away from end 24*a* of base member 24 and permitting substantially unimpeded movement of assembly 22 in a longitudinal direction toward forward end 24*a* of base member 24. Preferably, as is illustrated in FIG. 3, each assembly 22 includes 2 retard mechanisms 54 disposed in longitudinally spaced relationship. Each mechanism 54 comprises a pair of gate elements 56, each of which is attached, by means of a corresponding hinge 58, to a respective keel 28. As can be seen in FIG. 3, the hinges 58 present means mounting gate elements 56 on base member 22 for swinging about an axis extending generally perpendicularly relative to the major plane of web section 26. The elements 56 each have a length which is approximately one-half the width of web 26 and the axes of swinging of elements 56 presented by hinges 58 are disposed on opposite sides of base member 22 whereby the gate elements are swingable between a first position where the same are disposed to extend generally longitudinally of keels 28, as illustrated by the solid lines in FIG. 3, and a second position where the same are disposed to extend generally laterally of keels 28 to impede the movement of the assembly, as illustrated by the dashed lines in FIG. 3. Each mechanism 54 also includes stop means in the nature of pins 60 disposed for limiting the swinging movement of gate elements 56 and maintaining the latter in their second positions during said impeded movement of the assembly.

Another embodiment of stop means for the mechanisms 54 is illustrated in FIGS. 12, 13 and 14. In this embodiment, the gate elements 56 are attached to respective keels 28 by hinge means 158. Hinge means 158 includes a bushing plate 160 which is provided with a hole 162. As can best be seen in FIG. 13, hole 162 comprises a 270° segment of a circle presenting arcuately spaced abutments 162*a* and 162*b*.

Gate element 56 is provided with a shaft 164 disposed at the hinged end thereof, and as can best be seen in FIG. 14, one end of shaft 164 has a semi circular transverse cross-sectional configuration presenting a flat surface 166. The plane of surface 166 extends generally along the central longitudinal axis of shaft 164 and cooperates with abutments 162*a* and 162*b* to limit the rotation of shaft 164 in hole 162 to 90° as can best be visualized viewing FIG. 12. Thus, gate element 56 is swingable between the first position illustrated in FIG. 12 where flat 166 contacts abutment 162*a* and a second position with flat 166 in contact with abutment 162*b* where gate element 56 is in its second position disposed to extend generally perpendicularly of keel 28.

A support bushing such as the bushing 160 and a flat 166 may be used at each end of shaft 164 to appropriately support the latter for swinging relative to keel 28. However, as will be appreciated by those skilled in the art, one bushing could have a completely circular hole while the other has a hole such as the hole 162 to limit the rotation of the shaft 164.

If desired, a retard starter means 62 may be provided for the retard mechanisms for the purpose of shifting gate elements 56 toward their movement impeding positions at the beginning of the operation when movement is desirably impeded. Starter means 62 is illustrated in FIGS. 9 and 10 of the drawings and includes a foot actuated, spring loaded operator means 64 comprising a plate 66 mounted at the bottom of opening 40 in member 32 for movement toward and away from central web section 26. In this connection, it is to be understood that an appropriate concavity is provided in the lower side of member 32 to facilitate the movement of plate 66 toward and away from web 26. Retard starter means 62 also comprises wedge means in the nature of a wedge 68 for each gate element 56. Wedges 68 are rigidly coupled to plate 66 by shafts 70 which extend through openings 72 in web section 26. Accordingly, movement of plate 66 toward web section 26 causes a corresponding movement of wedges 68 between the corresponding gate element 56 and keel 28 whereby gate elements 56 are forced away from keels 28 and toward their second positions against pins 60. Coil springs 73 are mounted in encircling relationship with respect to shafts 70 and operate between web section 26 and plate 66 for biasing the latter away from web section 26.

Another, much simpler embodiment of retard starter means for gate elements 56 is illustrated in FIG. 12. In this embodiment, gate element 56 contacts and compresses a coil spring 168 when gate element 56 swings into its first position as illustrated in FIG. 12. At the beginning of the operation when movement is desirably impeded, spring 168 operates to yieldably bias element 56 toward its second position.

Guide means 74, which are particularly illustrated in FIG. 5, are included for the purpose of maintaining assemblies 22 in parallel relationship during operation. Guide means 74 comprises an elongated tubular frame 76 which extends longitudinally of assemblies 22 and is disposed therebetween. Guide means 74 also includes arm means 78 carried by each assembly 22 for interconnecting the latter and frame 76.

Frame 76 comprises a pair of tubular lengths 80 which extend longitudinally of assemblies 22 in laterally spaced relationship. Frame 76 also includes a bight portion 82 at each end thereof interconnecting lengths 80. Each arm means 78 includes an arm element 84 and a fitting in the nature of a ring 86 disposed in encircling relationship with respect to the corresponding length 80. The internal diameter of each ring 86 is greater than the external diameter of the corresponding length 80 whereby each arm element 84 is mounted on frame 76 for longitudinal movement therealong and swinging movement relative thereto about an axis extending generally longitudinally of assemblies 22. Moreover, the internal diameter of each ring 86 is preferably sufficiently large with respect to the outer diameter of the corresponding length 80 to permit slight angular movement of the assemblies relative to one another in the horizontal plane so that turning is facilitated.

Preferably, as can be seen in FIG. 5, a pair of longitudinally spaced arm elements 84 are provided for each assembly 22, and each arm element is elongated and curved as illustrated in FIGS. 7 and 8. The ring 86 is mounted at one end of each arm 84 and hinge means 88 are provided for each arm element 84 for mounting the end of the latter remote from ring 86 on the corresponding element 22 for swinging movement about an axis which extends generally longitudinally of the assembly 22. Each hinge means 88 includes a plate 90 having a slot 92 therein for receiving a corresponding strap 44 whereby the hinge means 88 may be secured to the corresponding assembly 22, as can best be seen in FIGS. 7 and 11.

Figure 6:
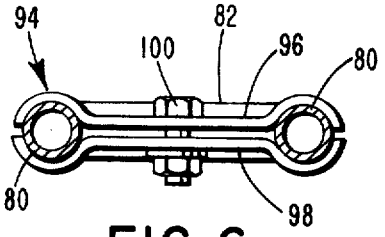
FIG. 6 is an enlarged, elevational cross-sectional view taken along the line 6—6 of FIG. 5.

Stop means in the nature of a clamp 94 may be provided at each end of frame 76 for limiting the longitudinal movement of each assembly 22 relative to frame 76. In this connection, the clamp 94 includes upper and lower portions 96 and 98 which are forced together by a nut and bolt assembly 100 as can best be seen viewing FIG. 6. When nut and bolt assembly 100 is tightened, the ends of upper and lower portions 96 and 98 are clamped against corresponding lengths 80 of frame 76, as can be seen in FIG. 6 and therefore clamp 94 is maintained in a fixed position relative to lengths 80. However when assembly 100 is loosened, the entire clamp 94 may be moved along lengths 80 to any desired position. As can particularly be seen in FIG. 5, the rings 86 of the right hand arm elements 84 are disposed to engage the right hand clamp 94 when the respective assembly 22 is moved to the right (FIG. 5) relative to frame 76. Manifestly, when the nut and bolt assembly 100 of the right hand clamp 94 is loosened, the latter may be moved to the left relative to frame 76 whereby to shorten the longitudinal distance that the assemblies 22 may be moved to the right relative to frame 76.

If desired, a longitudinal extension in the nature of a member 102 may be attached to the rear of base member 22 by nut and bolt means 104 as can be seen in FIG. 1. Preferably, extension member 102 has the same H-shaped transverse cross-sectional configuration as base member 22. A hollow, buoyant container 106 including a lid 108 is strapped to the central web 110 of member 102 by strap means 112 which includes a buckle 114. Manifestly, strap 112 and buckle 114 may be identical with the straps 44 and the buckles 50 of the main assembly 22 and in this connection member 102 is provided with brackets 115 which are identical with the brackets 52 for the purpose of attaching strap means 112 to the sides of member 102.

The operation of apparatus 20 is best explained viewing FIG. 5 wherein it should be appreciated that the assemblies 22 are floating on a body of water. The desired direction of travel is toward the right and therefore the user has his right foot in the opening 40 of the lowermost assembly 22 and his left foot in the opening 40 of the uppermost assembly 22. Assuming that the user wishes to move his right foot first, he pushes forward (to the right in FIG. 5) on the lowermost assembly 22 whereupon the gate elements 56 of that assembly 22 move into the solid line positions thereof illustrated in FIG. 3 whereby substantially unimpeded movement of the lowermost assembly 22 is permitted in a right hand direction. Simultaneously with the thrusting of the lowermost assembly 22 to the right, an opposite reaction occurs with respect to the uppermost assembly 22 and that assembly is correspondingly urged toward the left in FIG. 5. However, at this time the gate elements 56 of the uppermost assembly 22 are swung into their dashed line position (FIG. 3) by water pressure to thereby impede the movement of the uppermost assembly 22 to the left. The assemblies 22 are maintained in parallelism by frame 76 and in this connection it is to be noted that the length of the stride permitted will be the distance between the clamps 94 and the central connecting member 116 of frame 76.

After a full stride has been taken with the lowermost assembly 22, the uppermost assembly 22 may be urged forwardly by the left hand foot of the user whereupon the gate elements 56 of the lowermost assembly 22 will be swung into their dashed line positions (FIG. 3) by water pressure to impede the backward movement of the lowermost assembly 22 and at the same time the gate elements 56 of the uppermost assembly 22 will swing into the dashed line positions illustrated in FIG. 3 where substantially unimpeded movement of the uppermost assembly 22 will be permitted. Thus, by alternately moving the assemblies 22 forwardly, movement over the surface of the water is accomplished.

In the embodiment illustrated in FIGS. 9 and 10, at the end of each forward stride of a respective assembly 22, the weight of the user will be shifted to the forward most assembly while the other assembly is being urged forwardly by the foot of the user. When the users weight is shifted to the assembly whose backward motion is to be impeded, plate 66 will be forced downwardly toward section 26 and wedges 68 will start the movement of gate elements 56 toward the dashed line positions thereof illustrated in FIG. 3, so that gate elements 56 will be in a position to impede the rearward movement of the assembly 22 upon which the weight of the user has been shifted. That is to say, the assemblies 22 are moved forwardly alternately and as each respective assembly 22 is moved forwardly relative to the other assembly 22, the weight of the user is shifted to the other assembly 22 and the movement of the assembly 22 to which the weight has been shifted is desirably impeded in a direction oppositely to the desired direction of travel. This shifting of the weight of the user operates the retard starter assembly to initiate the movement of gate elements 56 into their movement impeding positions illustrated by the dashed lines in FIG. 3.

Viewing FIGS. 7 and 8, it should first be noted that arm elements 84 are swingable relative to hinge means 88 about horizontal axes 118 provided by the latter. Also, arm elements 84 are swingable relative to frame 76 about the axes 120 provided by virtue of the fact that ring elements 86 are disposed in encircling relationship to lengths 80. In this connection, swinging movement of each of the arm elements 84 relative to the corresponding length 80 of frame 76 is permitted by virtue of the fact that the internal diameter of each ring 86 is greater than the external diameter of the corresponding length 80.

Because arm elements 84 are swingable relative to hinges 88 about axes 118 and are also swingable relative to the frame 76 about axes 120, the entire frame member 76 can be caused to be swung upwardly to assume the position illustrated in FIG. 8. Hook means 122 may be provided to lock the assemblies 22 together when frame 76 is disposed as illustrated in FIG. 8. Manifestly, when frame 76 is disposed in the position illustrated in FIG. 8, and when hook means 122 are secured, frame 76 will present a seat for the user of the apparatus.

I claim:

1. Buoyant water-walking apparatus including a pair of elongated buoyant water-walker assemblies adapted for attachment to the feet of a user, each of said assemblies comprising:

a rigid, elongated base member comprising a longitudinally extending central web section having lateral edges and a pair of longitudinally extending flange sections attached respectively to a corresponding edge of the web section and extending generally normally away from the latter in the same direction to present laterally spaced keels;

at least one buoyant flotation member carried by said web section on the opposite side thereof from the direction of extension of the flange sections, said flotation member being generally coextensive in length and width with said web section and having an opening extending therethrough in a direction which is generally normal to the major plane of the web section, said opening being adapted for receiving the foot of a user of the apparatus therein;

said base member has a generally H-shaped transverse cross-sectional configuration presenting said web section and said keels, and also presenting a pair of wall sections extending in the opposite direction from said keels, said flotation member being disposed between said wall sections; and, means detachably securing said flotation member and said base member together to present said assembly.

2. Water-walking apparatus comprising a pair of elongated, buoyant water-walker members, each adapted for attachment to the foot of the user, and guide means for maintaining the members in parallel relationship during operation, said guide means comprising:

an elongated, tubular frame extending longitudinally of the members and therebetween; and arm means carried by each member for interconnecting the latter and the frame, each arm means comprising a curved arm element and mounting means having a fitting for mounting the corresponding arm element on the frame for longitudinal movement therealong and swinging movement relative thereto about an axis extending generally longitudinally of the members, said mounting means being disposed on the upper surface of said member whereby the frame may be swung upwardly relative to the members from a position between the latter to a position thereabove.

3. Apparatus as set forth in claim 2 wherein said frame comprises a pair of tubular lengths extending longitudinally of the members in laterally spaced relationship and a bight portion at each end of the frame interconnecting said lengths, said fittings comprising rings disposed in encircling relationship to a corresponding one of said lengths.

4. Apparatus as set forth in claim 3 wherein is included stop means releasably clamped to said lengths and slidable therealong when released for limiting the longitudinal movement of each assembly relative to the frame.

5. Apparatus as set forth in claim 3 wherein the arm means of each member comprises a pair of longitudinally spaced arm elements, each arm element comprising an elongated arm having said ring at one end thereof, said mounting means mounting the other end of each arm on the corresponding member for swinging movement about an axis extending longitudinally of the member.

6. Apparatus as set forth in claim 5 wherein is included stop means releasably clamped to said lengths and slidable therealong when released for limiting the longitudinal movement of each assembly relative to the frame.

7. Apparatus as set forth in claim 2 wherein the arm means of each member comprises a pair of longitudinally spaced arm elements, each arm element comprising an elongated arm having said fitting at one end thereof, said mounting means mounting the other end of each arm on the corresponding member for swinging movement about an axis extending longitudinally of the member.

8. Buoyant water-walking apparatus including a pair of elongated buoyant water-walker assemblies adapted for attachment to the feet of a user, each of said assemblies comprising:

a rigid, elongated base member comprising a longitudinally extending central web section having lateral edges and a pair of longitudinally extending flange sections attached respectively to a corresponding edge of the web section and extending generally normally away from the latter in the same direction to present laterally spaced keels;

at least one buoyant flotation member carried by said web section on the opposite side thereof from the direction of extension of the flange sections, said flotation member being generally coextensive in length and width with said web section and having an opening extending therethrough in a direction which is generally normal to the major plane of the web section, said opening being adapted for receiving the foot of a user of the apparatus therein;

means detachably securing said flotation member and said base member together to present said assembly; and a retard mechanism mounted between said keels for impeding the movement of the assembly through the water in one longitudinal direction and permitting substantially unimpeded movement thereof in the opposite longitudinal direction, said retard mechanism including a gate element and means mounting the element on said base member for swinging about an axis extending generally perpendicularly relative to the major plane of said web section, said gate element of each retard mechanism is swingable between a first position where the same is disposed to extend generally longitudinally of said keels to permit said substantially unimpeded movement and a second position where it is disposed to extend generally laterally of the keels to impede the movement of the assembly, said retard mechanism including stop means disposed for limiting the swinging movement of the gate element to maintain the latter in said second position during said impeded movement of the assembly, and said retard mechanism further including retard starter means having foot actuated, spring loaded operator means and wedge means coupled to said operator means for movement by the latter to force the gate element toward said second position at the beginning of said impeded movement.

9. Apparatus as set forth in claim 8 wherein said stop means for limiting the swinging movement of the gate element comprises a shaft having a portion provided with a flat surface extending longitudinally of the axis of the shaft and means defining a hole comprising a segment of a circle presenting arcuately spaced abutments, said portion of the shaft being disposed in said hole.

10. Apparatus as set forth in claim 8 wherein is included retard starter means comprising means yieldably biasing the gate element from said first position and toward said second position.

11. Apparatus as set forth in claim 10 wherein said yieldable biasing means comprises a coil spring disposed between the gate element and the keel.

12. Buoyant water-walking apparatus including a pair of elongated buoyant water-walker assemblies adapted for attachment to the feet of a user, each of said assemblies comprising:

a rigid, elongated base member comprising a longitudinally extending central web section having lateral edges and a pair of longitudinally extending flange sections attached respectively to a corresponding edge of the web section and extending generally normally away from the latter in the same direction to present laterally spaced keels;

at least one buoyant flotation member carried by said web section on the opposite side thereof from the direction of extension of the flange sections, said flotation member being generally coextensive in length and width with said web section and having an opening extending therethrough in a direction which is generally normal to the major plane of the web section, said opening being adapted for receiving the foot of a user of the apparatus therein;

means detachably securing said flotation member and said base member together to present said assembly; and a retard mechanism mounted between said keels for impeding the movement of the assembly through the water in one longitudinal direction and permitting substantially unimpeded movement thereof in the opposite longitudinal direction, said retard mechanism including a pair of gate elements and means mounting the element on said base member for swinging about an axis extending generally perpendicularly relative to the major plane of said web section, the axes of swinging of said gate elements being disposed on opposite sides of the base member adjacent a respective keel, each gate element having a length which is approximately one-half the width of said central web.

13. Apparatus as set forth in claim 12 wherein each gate element of each retard mechanism is swingable between a first position where the same is disposed to extend generally longitudinally of said keels to permit said substantially unimpeded movement and a second position where it is disposed to extend generally laterally of the keels to impede the movement of the assembly, said mechanism including stop means disposed for limiting the swinging movement of each gate element to maintain the latter in their second positions during said impeded movement of the assembly.

14. Apparatus as set forth in claim 13 wherein said retard mechanism includes retard starter means comprising foot actuated, spring loaded operator means and wedge means coupled to said operator means for movement by the latter to force the gate elements toward their second positions at the beginning of said impeded movement.

15. Apparatus as set forth in claim 14 wherein said operator means comprises a plate mounted in said opening for movement toward and away from said central web and spring means biasing said plate away from said web, said wedge means comprising a wedge for each gate element disposed for movement toward and away from said web on the opposite side of the latter from the plate and between the corresponding gate element and the keel adjacent thereto, there being means rigidly coupling said wedges and said plate whereby movement of the latter toward the web causes a corresponding movement of the wedges to force the gate elements away from the keels and toward their second positions.

16. Apparatus as set forth in claim 12 wherein each of said assemblies includes two of said retard mechanisms disposed in longitudinally spaced relationship.

17. Buoyant water-walking apparatus including a pair of elongated buoyant water-walker assemblies adapted for attachment to the feet of a user, each of said assemblies comprising:

a rigid, elongated base member comprising a longitudinally extending central web section having lateral edges and a pair of longitudinally extending flange sections attached respectively to a corresponding edge of the web section and extending generally normally away from the latter in the same direction to present laterally spaced keels;

at least one buoyant flotation member carried by said web section on the opposite side thereof from the direction of extension of the flange sections, said flotation member being generally coextensive in length and width with said web section and having an opening extending therethrough in a direction which is generally normal to the major plane of the web section, said opening being adapted for receiving the foot of a user of the apparatus therein;

means detachably securing said flotation member and said base member together to present said assembly; and guide means for maintaining the assemblies in parallel relationships during operation, said guide means including: an elongated tubular frame extending longitudinally of the assemblies therebetween, said frame having a pair of tubular lengths extending longitudinally of the assemblies in laterally spaced relationship and a bight portion at each end of the frame interconnecting said lengths; arm means carried by each assembly for interconnecting the latter and said frame, each arm means including a pair of longitudinally spaced arm elements; and fittings for mounting corresponding said arm elements on the frame for longitudinal movement therealong and swinging movement relative thereto about an axis extending generally longitudinally of the assemblies, said fittings having rings disposed in encircling relationship to a corresponding one of said lengths; each said arm element having an elongated arm having said ring at one end thereof, there being included means mounting the other end of each arm on the corresponding assembly for swinging movement about an axis extending longitudinally of the assembly; and said arms being curved, said means mounting the arms on the assemblies being disposed on top of the uppermost flotation member thereof whereby the frame may be swung upwardly relative to the assemblies from a position between the latter to a position thereabove.

18. Apparatus as set forth in claim 17 wherein is included stop means releasably clamped to said lengths and slidable therealong when released for limiting the longitudinal movement of each assembly relative to the frame.

19. Buoyant water-walking apparatus including a pair of elongated buoyant water-walker assemblies adapted for attachment to the feet of a user, each of said assemblies comprising:

a rigid, elongated base member comprising a longitudinally extending central web section having lateral edges and a pair of longitudinally extending flange sections attached respectively to a corresponding edge of the web section and extending generally normally away from the latter in the same direction to present laterally spaced keels;

at least one buoyant flotation member carried by said web section on the opposite side thereof from the direction of extension of the flange sections, said flotation member being generally coextensive in length and width with said web section and having an opening extending therethrough in a direction which is generally normal to the major plane of the web section, said opening being adapted for receiving the foot of a user of the apparatus therein;

means detachably securing said flotation member and said base member together to present said assembly; and guide means for maintaining the assemblies in parallel relationships during operation, said guide means including: an elongated tubular frame extending longitudinally of the assemblies therebetween; and arm means carried by each assembly for interconnecting the latter and the frame, each arm means including an arm element and a fitting mounting the corresponding arm element on the frame for longitudinal movement therealong and swinging movement relative thereto about an axis extending generally longitudinally of the assemblies; said arm means of each assembly having a pair of longitudinally spaced arm elements, each arm element having a curved elongated arm having said fitting at one end thereof, and there being included means mounting the other end of each arm on the corresponding assembly for swinging movement about an axis extending longitudinally of the assembly, said means mounting the arms on the assemblies being disposed on top of the uppermost flotation member thereof whereby the frame may be swung upwardly relative to the assemblies from a position between the latter to a position thereabove.

* * * * *